US008967767B2

(12) United States Patent
Maruyama

(10) Patent No.: US 8,967,767 B2
(45) Date of Patent: Mar. 3, 2015

(54) LIQUID EJECTING APPARATUS

(71) Applicant: Seiko Epson Corporation, Tokyo (JP)

(72) Inventor: Akihiko Maruyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/790,133

(22) Filed: Mar. 8, 2013

(65) Prior Publication Data

US 2013/0241995 A1 Sep. 19, 2013

(30) Foreign Application Priority Data

Mar. 14, 2012 (JP) ..... 2012-057371

(51) Int. Cl.
*B41J 2/165* (2006.01)

(52) U.S. Cl.
CPC ..... *B41J 2/16523* (2013.01); *B41J 2/1652* (2013.01)
USPC ..... 347/36

(58) Field of Classification Search
CPC ..... B41J 2/165; B41J 2/1605; B41J 2/16508; B41J 2/16517; B41J 2/16523; B41J 2/1721; B41J 2002/1728
USPC ..... 347/36
See application file for complete search history.

(56) References Cited

U.S. PATENT DOCUMENTS

| | | | | |
|---|---|---|---|---|
| 6,619,783 | B2 * | 9/2003 | Kanaya et al. | 347/35 |
| 6,932,456 | B2 * | 8/2005 | Kanaya et al. | 347/29 |
| 2009/0015632 | A1 * | 1/2009 | Suzuki et al. | 347/36 |
| 2012/0200636 | A1 * | 8/2012 | Frazier et al. | 347/36 |

FOREIGN PATENT DOCUMENTS

| | | |
|---|---|---|
| JP | 2006-192862 | 7/2006 |

* cited by examiner

*Primary Examiner* — Stephen Meier
*Assistant Examiner* — Renee I Wilson
(74) *Attorney, Agent, or Firm* — Workman Nydegger

(57) ABSTRACT

A liquid ejecting apparatus includes a liquid ejecting head that ejects liquid from nozzles; a liquid accommodation body having a liquid receiving surface configured to accommodate the liquid flushed from the nozzles; a pump that discharges the liquid; a liquid supply flow path that discharges the liquid discharged by the pump toward the liquid receiving surface in the liquid accommodation body; and a liquid discharge flow path that discharges the liquid from the liquid accommodation body.

6 Claims, 10 Drawing Sheets

LIQUID EJECTING APPARATUS

BACKGROUND

1. Technical Field

The present invention relates to a liquid ejecting apparatus that ejects liquid from a liquid ejecting head.

2. Related Art

From the related art, as a type of liquid ejecting apparatuses, ink jet type printers have been widely known which eject ink (liquid) to a target such as paper from nozzles formed in the liquid ejecting head to perform recording. In such printers, in order to suppress clogging of the nozzles of a recording head (liquid ejecting head), flushing is performed which ejects (that is, discharges) the ink from the nozzles that waste ink (waste fluid) based on a control signal unrelated to recording with respect to the target.

For example, a liquid ejecting apparatus disclosed in JP-A-2006-192862 is provided with a block-shaped inclined surface member including an inclined surface portion (a liquid receiving surface) that receives the ink discharged from the nozzles of the recording head by the flushing operation and causes the received waste ink to flow down toward a waste ink tank side. Moreover, in the liquid ejecting apparatus, at the time of flushing, among various inks ejected from a plurality of nozzles, ink which is relatively hard to solidify rather than ink which is relatively easy to solidify is ejected toward an upper position of the inclined surface portion. That is, among various inks ejected from the nozzles and attached to the inclined surface portion, since the ink attached to the upper position is hard to solidify and flows down the inclined surface portion while maintaining fluidity, the ink flowing down from the upper position is mixed with the ink which is attached to a position lower than the upper position and is easily solidified while flowing down, and various inks flow down the inclined surface portion together and are collected in the waste ink tank.

However, among various inks attached onto the inclined surface portion of the inclined surface member configured to receive the ink ejected from the liquid ejecting heads due to flushing, in some cases, the ink which is easy to solidify may be deposited on the inclined surface portion and may be aggregated. Meanwhile, although the ink, which is ejected to the upper position of the inclined surface portion and is hard to solidify, is not aggregated and flows down along the inclined surface, power of the flow thereof is only weak enough to flow down according to gravity. For that reason, in the flow of ink of weak power, because the ink is easily solidified, it is difficult to cause the deposited and aggregated ink to flow down from the inclined surface. As a result, there was a problem that the waste ink cannot be collected in the waste ink tank.

In addition, such facts are almost common in liquid ejecting apparatuses having a receiving surface of liquid discharged from the liquid ejecting head as waste fluid, without being limited to an ink jet type printer including the flushing box having the receiving surface of the waste ink.

SUMMARY

An advantage of some aspects of the invention is to provide a liquid ejecting apparatus that has a receiving surface of liquid discharged from a liquid ejecting head as waste fluid, and is able to cause the liquid attached to the liquid receiving surface to flow down from the liquid receiving surface using the flow of the waste fluid so as not to be solidified in an aggregated form.

According to an aspect of the invention, there is provided a liquid ejecting apparatus that includes a liquid ejecting head that ejects liquid from nozzles; a liquid accommodation body having a liquid receiving surface configured to accommodate liquid flushed from the nozzles; a pump that discharges the liquid; a liquid supply flow path that discharges the liquid discharged by the pump toward the liquid receiving surface in the liquid accommodation body; and a liquid discharge flow path that discharges the liquid from the liquid accommodation body.

According to the liquid ejecting apparatus of the aspect of the invention, when the liquid is ejected (that is, flushed) toward the liquid accommodation body from the nozzles of the liquid ejecting head as the waste fluid in the state of liquid droplets, the liquid is attached to the liquid receiving surface of the liquid accommodation body. Meanwhile, when the pump is driven, the liquid discharged from the pump is led to the liquid accommodation body via a liquid supply path, and is discharged toward the liquid receiving surface on which the liquid is attached in the liquid accommodation body. Thus, it is possible to cause the liquid attached onto the liquid receiving surface to flow down from the liquid receiving surface using the flow of liquid so as not to be solidified.

Furthermore, in the liquid ejecting apparatus of the aspect of the invention, the pump may be a pump that discharges the liquid ejected from the nozzles of the liquid ejecting head via a cap capable of coming into contact with the nozzles so as to surround the nozzles.

According to the liquid ejecting apparatus of the aspect of the invention, when the pump is driven in the state of making the cap to be the contact position with respect to the liquid ejecting head, the liquid is forcibly discharged from the liquid ejecting head. Moreover, the liquid forcibly discharged in this manner is led to the liquid accommodation body via the cap and the liquid supply path, and is vigorously discharged toward the liquid receiving surface onto which the liquid is attached to the liquid accommodation body by discharge pressure due to the driving of the pump. Thus, it is possible to cause the liquid attached onto the liquid receiving surface to flow down from the liquid receiving surface using the flow of liquid so as not to be solidified.

Furthermore, in the liquid ejecting apparatus of the aspect of the invention, the liquid receiving surface may form an inclined surface shape, and a discharge port configured to discharge the liquid toward the liquid receiving surface from the liquid supply flow path may be formed on a lower side of the liquid receiving surface in a vertical direction. The liquid discharged toward the liquid receiving surface from the liquid supply path flows so as to run up the liquid receiving surface from the lower side, then flows so as to flow down along the liquid receiving surface, and flows out to the liquid discharge flow path from the liquid accommodation body.

According to the liquid ejecting apparatus of the aspect of the invention, the liquid discharged from the discharge port toward the liquid receiving surface from the liquid supply flow path may scrape off deposits of the liquid attached onto the liquid receiving surface when flowing on the inclined surface-shaped liquid receiving surface so as to run up from the down side. Moreover, the liquid flows so as to flow down on the liquid receiving surface along with deposits of the liquid scrapped off from the liquid receiving surface when running up, and then flows out to the liquid discharge flow path from the liquid accommodation body. For that reason, it is possible to reduce the risk of the solidification of the liquid attached onto the liquid receiving surface in the liquid accommodation body.

Furthermore, in the liquid ejecting apparatus of the aspect of the invention, the liquid supply flow path may be configured so that a height of a part connected to the liquid accommodation body in a vertical direction is lower than that of a part serving as the pump side.

According to the liquid ejecting apparatus of the aspect of the invention, it is possible to reduce a quantity of liquid remaining at the pump side after driving of the pump stops, in the liquid flowing to the liquid accommodation body side from the cap side via the liquid supply flow path due to driving of the pump.

Furthermore, in the liquid ejecting apparatus of the aspect of the invention, a flow path diameter of the liquid discharge flow path may be greater than a flow path diameter of the liquid supply flow path.

According to the liquid ejecting apparatus of the aspect of the invention, since the waste fluid flowed in via the liquid supply flow path can be discharged via the liquid discharge flow path having a diameter that is greater than the flow path diameter of the liquid supply flow path, it is possible to reduce the risk of unnecessary clog of the waste fluid in the liquid accommodation body.

Furthermore, in the liquid ejecting apparatus of the aspect of the invention, the inside of the liquid accommodation body formed with the liquid receiving surface may communicate with the atmosphere.

If the inside of the liquid accommodation body formed with the liquid receiving surface does not communicate with the atmosphere, when clogging is generated on the downstream side of the liquid discharge flow path, the waste fluid may flow backward to the inside of the liquid supply flow path of the upstream side via the liquid accommodation body due to the pressure. In this respect, according to the liquid ejecting apparatus of the aspect of the invention, even if clogging is generated on the downstream side of the liquid discharge flow path, since the pressure causing the backward flow is opened to the atmosphere in the liquid accommodation body communicating with the atmosphere, an occurrence of the backward flow can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment will be described in which the invention is embodied in an ink jet type printer as a kind of a liquid ejecting apparatus and a flushing box as a liquid accommodating apparatus included in the printer based on FIGS. 1 to 14.

Figure 1:
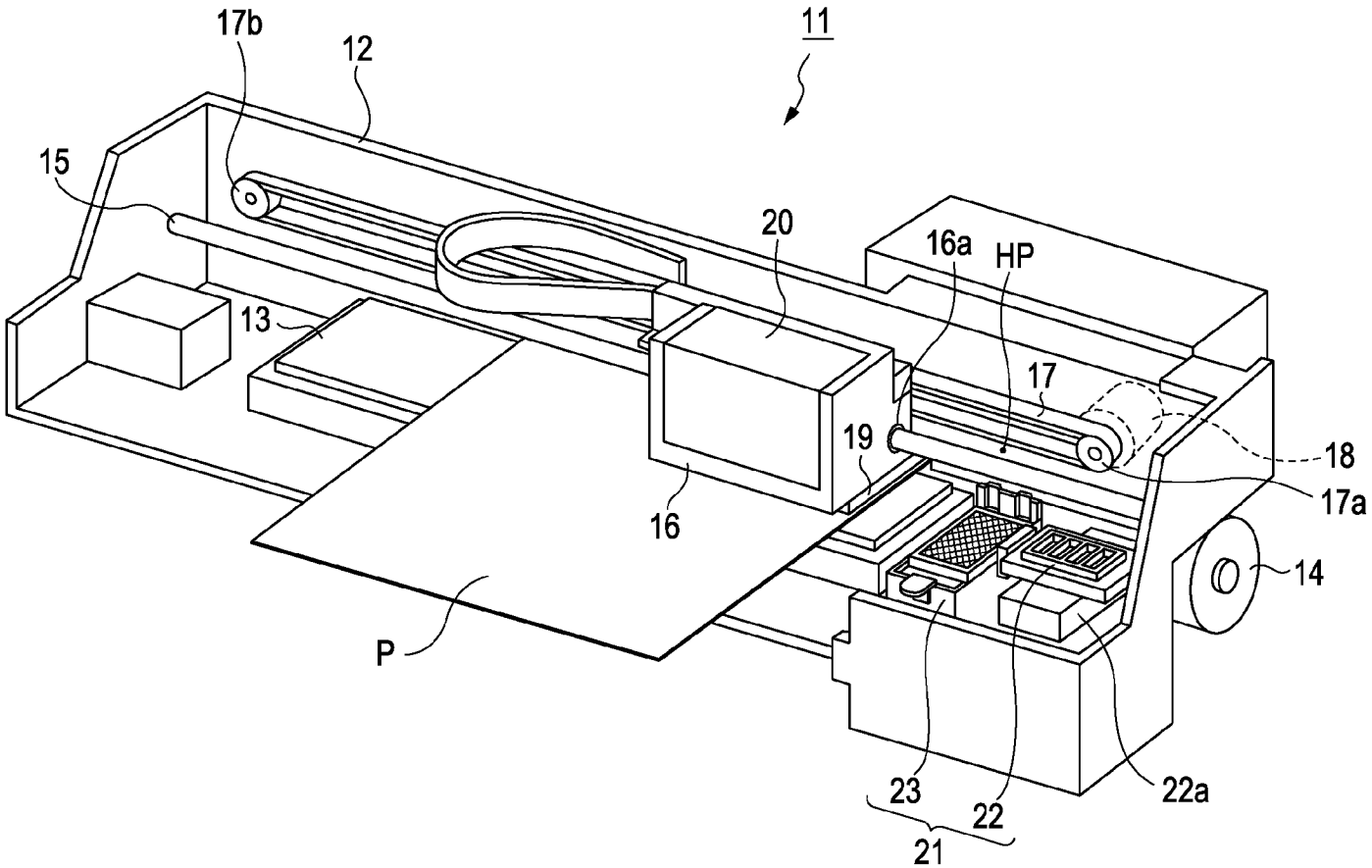
FIG. 1 is a perspective view of a printer of an embodiment related to the invention.

As illustrated in FIG. 1, a printer 11 of the present embodiment includes a frame 12 having a rectangular shape when viewed from a plane, and a support table 13 configured to support paper P as an example of a target which extends in a horizontal direction serving as a longitudinal direction of the frame 12, in the frame 12. Moreover, a paper transport mechanism having a paper transport motor 14 disposed on the backward side rather than the support table 13 is driven, whereby the paper P is fed on the support table 13 toward the front side from the rear side. Furthermore, a guide shaft 15 extending parallel to the longitudinal direction (the horizontal direction) of the support table 13 is built above the support table 13 in the frame 12.

A carriage (a moving element) 16 is supported by the guide shaft 15 so that the carriage 16 can reciprocate along an axial direction (the horizontal direction) of the guide shaft 15. Furthermore, at the positions corresponding to both end portions of the guide shaft 15 on the rear surface in the frame 12, a driving pulley 17*a* and a driven pulley 17*b* are supported in a freely rotatable manner. A carriage motor 18 driven when causing the carriage 16 to reciprocate is connected to the driving pulley 17*a*, and an endless timing belt 17, in which a part thereof in the longitudinal direction is fixed to the carriage 16, is wound between the pair of pulleys 17*a* and 17*b*. Thus, the carriage 16 horizontally moves via the timing belt 17 while being guided by the guide shaft 15 by driving of the carriage motor 18.

As illustrated in FIG. 1, a recording head 19 as an example of the liquid ejecting head is provided on the lower surface of the carriage 16. Meanwhile, an ink cartridge 20 for supplying the ink as liquid to the recording head 19 is mounted on the carriage 16 in a freely attachable or detachable manner. The ink cartridge 20 supplies the ink to a nozzle 19*b* (see FIG. 2) formed on a nozzle forming surface 19*a* (see FIG. 2) constituted on the lower surface of the recording head 19 via an ink flow path (not shown) formed in the recording head 19.

In addition, in one end portion (a right end portion in FIG. 1) in the frame 12 in the longitudinal direction, that is, in a non-printing region where the paper P does not reach, a home position HP is provided which locates the carriage 16 at the time of power-off of the printer 11 and when performing the maintenance of the recording head 19. Moreover, at a lower position of the home position HP, a maintenance system 21 is provided which performs various maintenance operations so that the ejection of ink with respect to the paper P from the nozzle 19*b* of the recording head 19 is satisfactorily maintained.

As illustrated in FIG. 1, the maintenance system 21 includes a box-shaped cap 22 with bottom corresponding to the nozzle forming surface 19*a* of the recording head 19, and a flushing box (hereinafter, referred to as a "FL box") 23 that receives the ink ejected (that is, discharged) from the nozzle 19*b* of the recording head 19 as the waste fluid based on the driving signal unrelated to printing with respect to the paper P. Furthermore, as shown in FIG. 2, the maintenance system 21 includes a waste ink tank 24 that collects the waste ink discharged from the FL box 23, at the lower position of the FL box 23 in the gravitational direction.

A waste ink supply tube 25 as a liquid supply flow path is connected between the cap 22 and the FL box 23, and a waste ink discharge tube 26 as a liquid discharge flow path is connected between the FL box 23 and the waste ink tank 24. Furthermore, in the middle of the waste ink supply tube 25, a suction pump 27 is provided which is pumped and driven when causing the waste ink to flow to the FL box 23 side from the cap 22 side. In addition, the suction pump 27 is a well-known so-called tube pump including a pressing member (not illustrated) that moves while crushing an intermediate portion of a waste ink supply tube 25 in the longitudinal direction supported by a peripheral wall inner surface of a cylindrical casing (not illustrated) between the intermediate portion and the peripheral wall inner surface toward the downstream side serving as the FL box 23 side from the upstream side serving as the cap 22 side along with driving of the pump.

Figure 2:
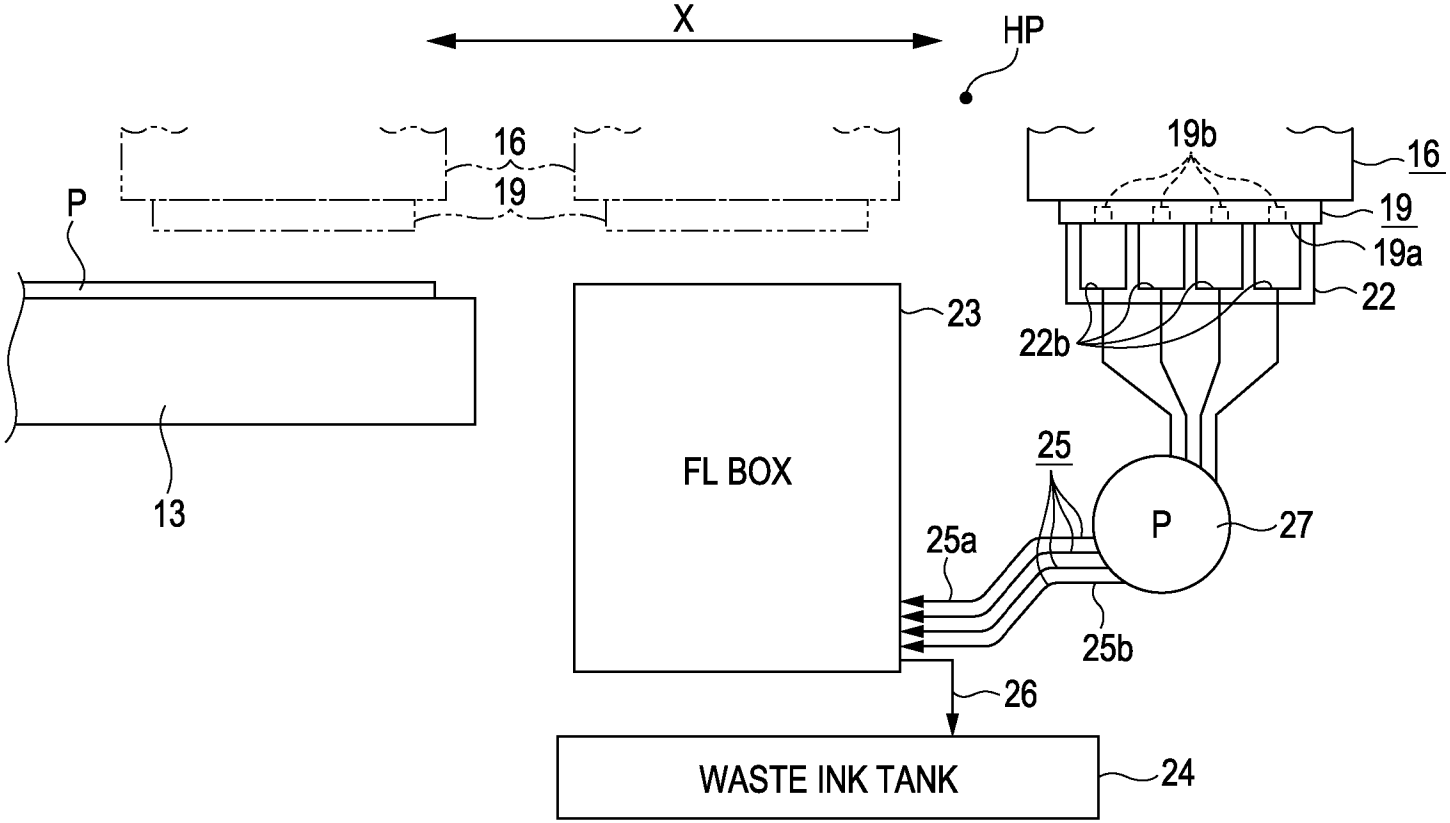
FIG. 2 is a front view that shows a schematic configuration of a maintenance system in the printer.
Figure 3:
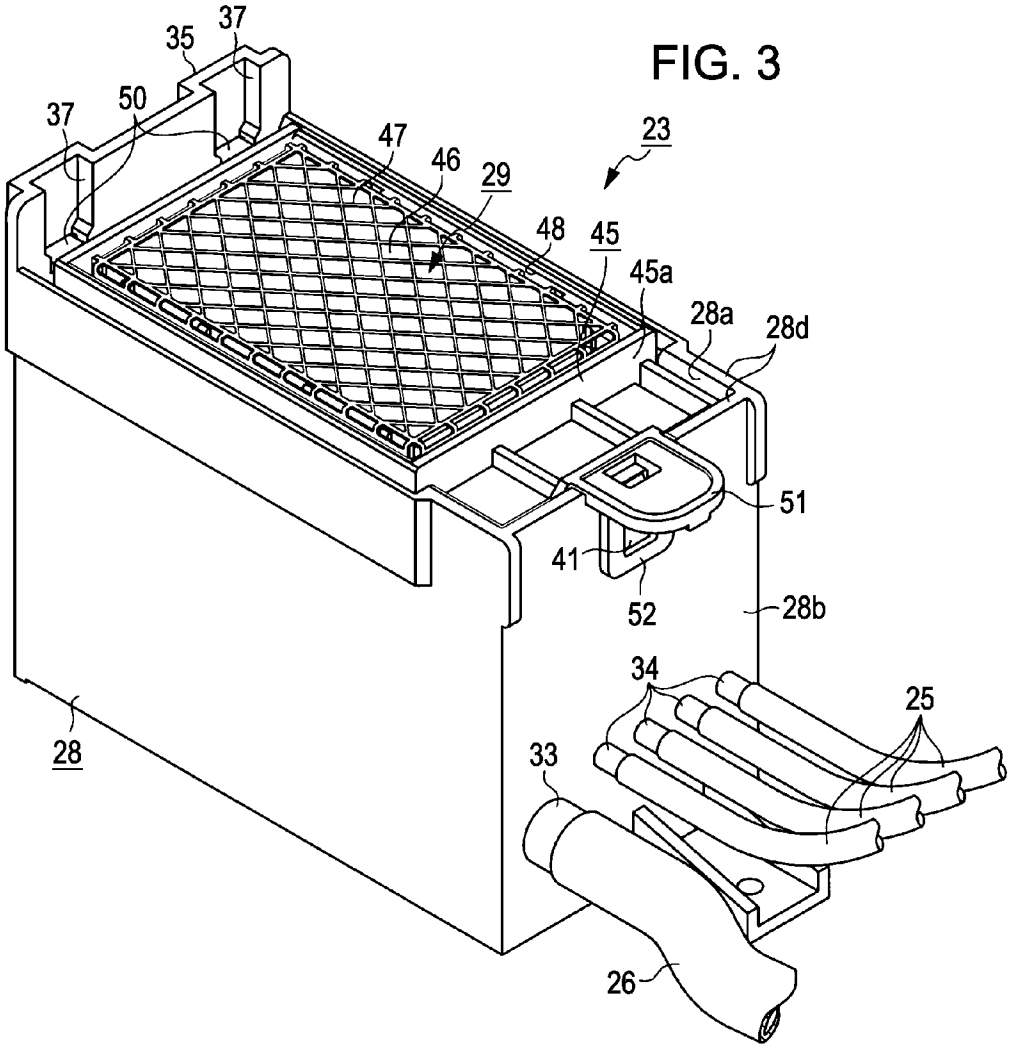
FIG. 3 is a perspective view of a flushing box.
Figure 4:
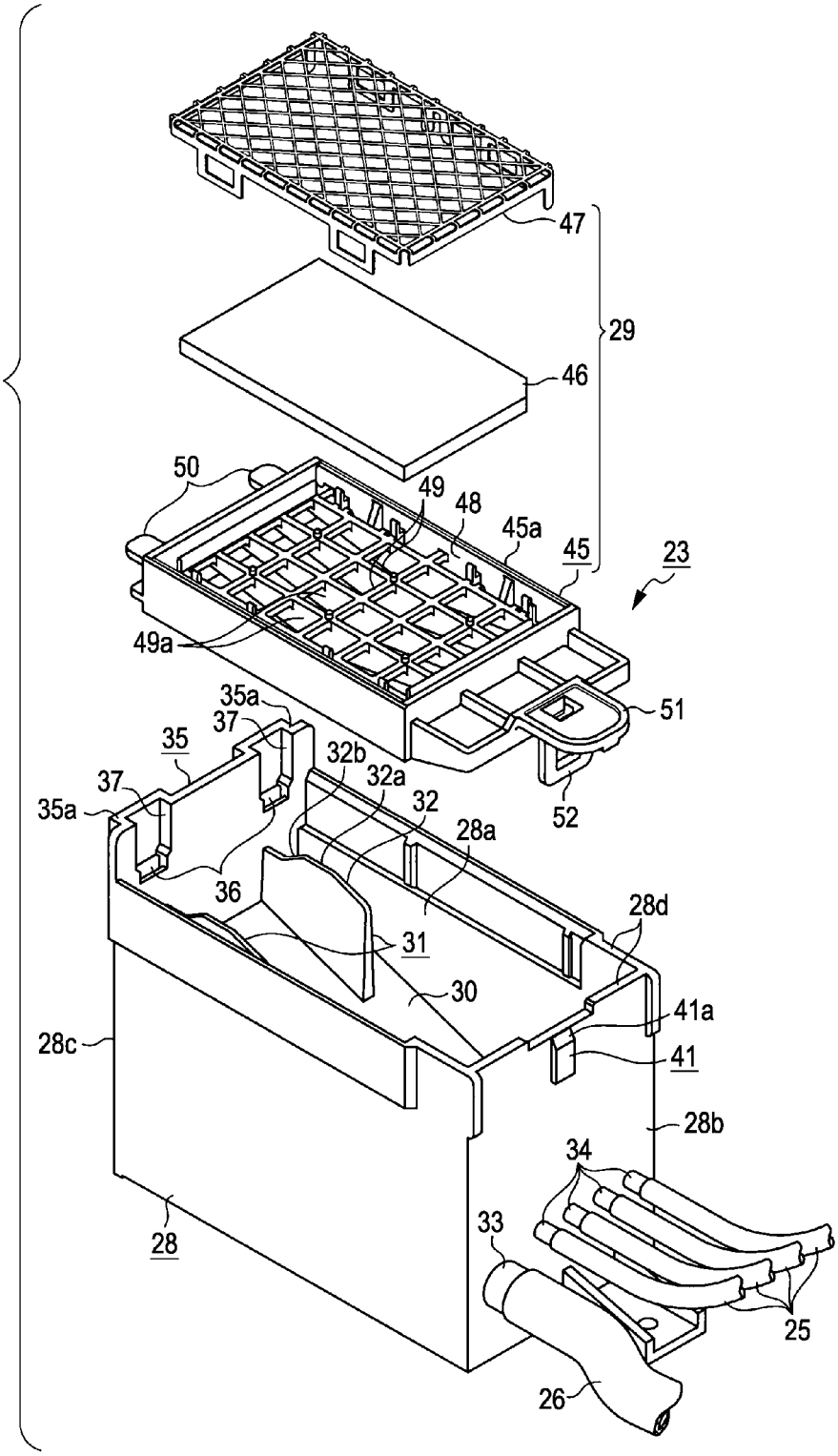
FIG. 4 is an exploded perspective view of the flushing box.

In addition, as illustrated in FIG. 2, the waste ink supply tube 25 is disposed so that, in the flowing direction of ink, a downstream side site 25*a* connected to the FL box 23 is lower than an upstream side site 25*b* serving as the suction pump 27 side in a height in the gravitational direction (the vertical direction). Furthermore, as shown in FIGS. 3 and 4, comparing the waste ink supply tube 25 with the waste ink discharge tube 26, a flow path diameter of the waste ink discharge tube 26 is greater than that of the waste ink supply tube 25. That is, the dimension of the flow path diameter of the waste ink discharge tube 26 is set so that the value of the flow path cross-sectional area thereof is greater than that of one waste ink supply tube 25 and is greater than the total value of the flow path cross-sectional areas of all (as an example, four in the embodiment) the waste ink supply tubes 25.

Furthermore, the cap 22 moves by driving of a lifting device 22*a* (see FIG. 1) between a contact position (a position shown in FIG. 2) capable of forming a closed space between the cap 22 and the nozzle forming surface 19*a* by coming into contact with the nozzle forming surface 19*a* of the recording head 19 so as to surround the nozzle 19*b*, and a non-contact position where the cap 22 does not contact with the nozzle forming surface 19*a* as a position separated downward from the contact position. Furthermore, the cap 22 includes a plurality (as an example, four in the embodiment) of cap areoles 22*b* corresponding to each of the nozzle rows of the recording head 19, and the upstream side end portions of four waste ink supply tubes 25 are individually connected to each of the cap areoles 22*b*. In addition, at a location between the cap 22 and the suction pump 27 in the four waste ink supply tubes 25, opening and clogging valves (not shown) are provided for each tube, and thus the selective maintenance operation for each nozzle row can be performed by the opening and clogging control of the valves.

As shown in FIG. 2, the carriage 16 is able to reciprocate between a printing region serving as an upper region of the support table 13 and the home position HP along a main scanning direction X serving as the horizontal direction. That is, at the time of printing, the ink is ejected toward the paper P supported by the support table 13 from the nozzle 19*b* of the recording head 19 while reciprocating in the printing region. Moreover, the images including characters, figures or the like are formed on the paper P by the printing operation.

Meanwhile, when the ink in the recording head 19 is thickened and air bubbles are mixed in the ink, the head cleaning as the maintenance operation of forcibly discharging the ink as the waste ink from the recording head 19 is performed. That is, as shown by a solid line in FIG. 2, the carriage 16 moves to the upper position of the cap 22 at the home position HP and stops. Moreover, after the cap 22 rises up to the contact position, when the suction pump 27 is driven, the ink is forcibly discharged as the waste fluid into the cap 22 from the nozzle 19*b*, and then the waste ink is discharged to the downstream side such as the FL box 23 from the cap 22 via the waste ink supply tube 25.

Furthermore, when a nozzle row including the nozzle 19*b*, which does not eject the ink over a long time, is present in the recording head 19, flushing is performed which ejects (that is, discharges) the ink as the waste ink (the waste fluid) in the state of the liquid droplet based on the driving signal unrelated to printing from the nozzle 19*b* of the nozzle row. In this case, the carriage 16 stops at the upper position of the FL box 23 at the home position HP. Then, the recording head 19 ejects (discharges) the ink as the waste ink toward the FL box 23 from the nozzle 19*b* requiring flushing, and the ink is accommodated in the FL box 23. Thus, in this respect, the FL box 23 functions as a liquid accommodation device that receives the liquid (ink) discharged from the nozzle 19*b* of the recording head 19 as the waste fluid at the time of flushing that is a kind of maintenance of the recording head 19.

As shown in FIGS. 3 and 4, the FL box 23 has a case (a liquid accommodation body) 28 which has an upward opening portion 28*a* having a rectangular shape corresponding to the nozzle forming surface 19*a* of the recording head 19 and in which the whole shape forms a rectangular parallelepiped shape, and a replacement component 29 having liquid absorption function that is mounted with respect to the case 28 in a freely attachable or detachable manner. The replacement component 29 includes a mounting member 45 having a rectangular frame body 45*a* corresponding to the opening portion 28*a* of the case 28, and an ink absorbent member (a liquid absorbent material) 46 having the ink absorption function assembled to the mounting member 45, and a wire netting member 47 that is fixed to the mounting member 45 in the state of covering the ink absorbent material 46 assembled to the mounting member 45. The ink flushed from the recording head 19 is attached onto the surface of the ink absorbent material 46, penetrates inside the ink absorbent material 46 and is absorbed. In addition, a part of the flushed ink is attached to the wire netting member 47, then is penetrated inside the ink absorbent material 46 and is absorbed by hanging down. Furthermore, since there is a minute gap between the frame body portion 45*a* of the mounting member 45 and the side wall of the case 28 in the state where the replacement component 29 is mounted into the opening portion 28*a* of the case 28, the inside of the FL box 23 communicates with the atmosphere via the gap.

As shown in FIG. 4, an accommodation concave portion 48 capable of accommodating a rectangular mat-shaped ink absorbent material 46 is formed on an upper surface side of the mounting member 45, and a plurality of ink dropping ports 49*a* is formed by a beam member 49 forming a lattice on a lower surface of the accommodation concave portion 48. For that reason, when the ink penetrates in the ink absorbent material 46 accommodated in the accommodation concave portion 48 of the mounting member 45 and is maintained, the ink moves downward in the ink absorbent material 46 with passage of time, and then drops down (hangs down) in the case 28 from the lower surface of the ink absorbent material 46 through the ink dropping port 49*a*.

Figure 5A:
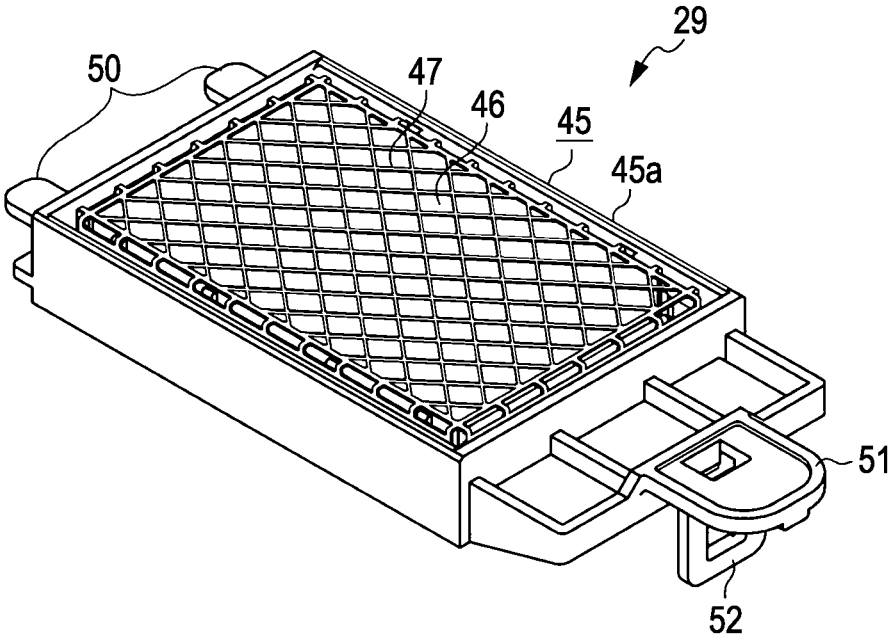
FIG. 5A is a perspective view when a replacement component is viewed from the upside obliquely.
Figure 5B:
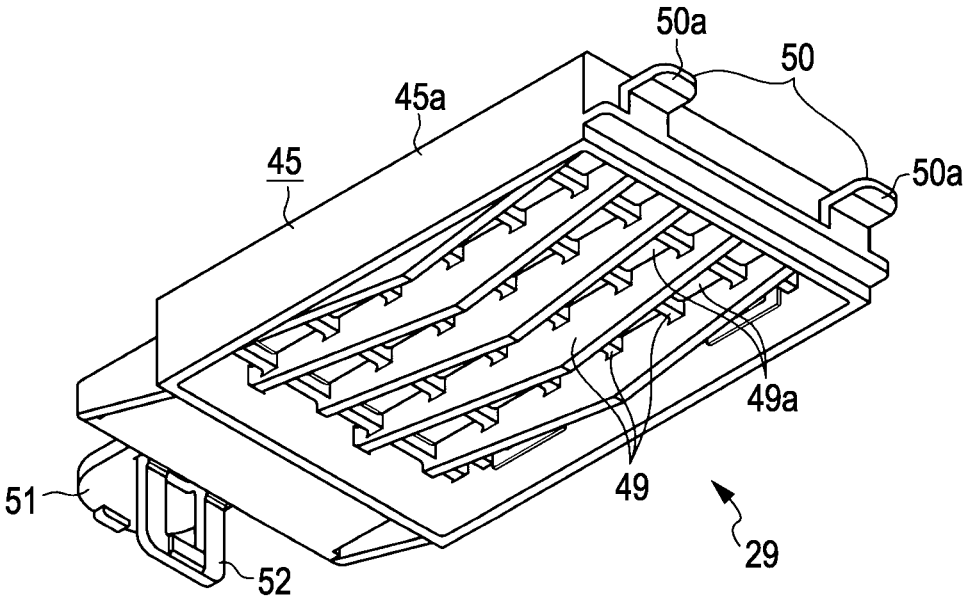
FIG. 5B is a perspective view when the replacement component is viewed from the downside obliquely.

Furthermore, as shown in FIGS. 4, 5A and 5B, a convex portion 50 forming a pair in a transverse direction of the frame body portion 45*a* protrudes toward one side (a mounting direction side to the case 28) in the longitudinal direction from one side surface (a left side in FIG. 4) in the longitudinal direction of the frame body portion 45*a* in the mounting member 45. In addition, as shown in FIG. 5B, the convex portion 50 has a rectangular cross-sectional shape perpendicular to the protrusion direction, and the lower surface is formed in a tapered surface 50*a* in which the thickness of the convex portion 50 becomes thinner as going toward the leading end.

Furthermore, a gripping portion 51 for gripping the mounting member 45 with a finger tip (see FIG. 7) when mounting the mounting member 45 into the opening portion 28*a* of the case 28 is formed from the side surface of the other side (a right side in FIG. 4) in the longitudinal direction of the frame body portion 45*a*. That is, by gripping the gripping portion 51, a user is able to displace the replacement component 29 of the ink absorption function portion, in which the ink absorbent material 46 is integrally incorporated into the mounting member 45, between an inclined posture with a lowered front and a horizontal posture when being attached to or detached from the case 28. Furthermore, an elastically deformable hook portion 52 protrudes downward from a site formed with the gripping portion 51 in the frame body portion 45*a*.

Figure 6A:
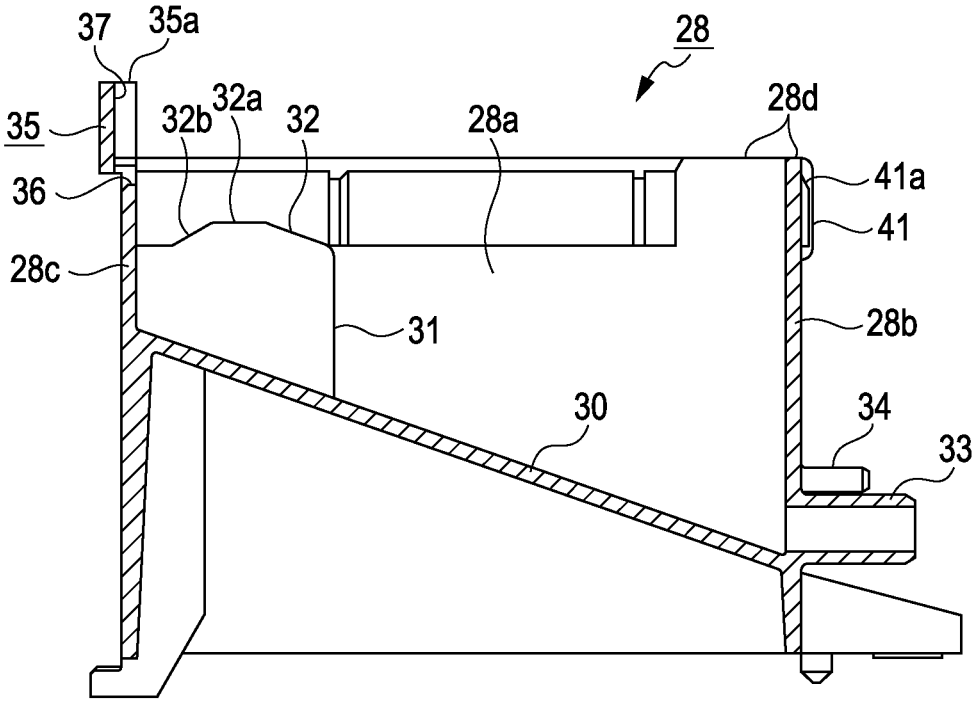
FIG. 6A is a cross-sectional view of a case in the flushing box.

Meanwhile, as shown in FIGS. 4 and 6A, the case 28 has an ink receiving surface (a liquid receiving surface) 30 that receives the ink dropped downward from the ink absorbent material 46 in the replacement component 29 mounted in the opening portion 28*a* via the dropping port 49*a* of the mounting member 45. The ink receiving surface 30 is formed in an inclined form so that one side (the left side in FIG. 4) in the longitudinal direction in the case 28 is located above the other side thereof (the right side in FIG. 4) in the gravitational direction. Moreover, at the position near the upside in the ink receiving surface 30 of the inclined from, a vertical plate-shaped rib 31 forming a pair in the transverse direction of the case 28 protrudes upward.

The rib 31 functions as a guide portion that guides the frame body portion 45*a* of the mounting member 45 while causing the frame body portion 45*a* to slide to one side (the left side in FIGS. 4 and 6A) in the longitudinal direction of the case 28 when the replacement component 29 is mounted into the opening portion 28*a* of the case 28, and the upper edge portions 32 of each rib 31 are formed so as to extend along the longitudinal direction of the case 28 serving as the mounting direction. In addition, a top portion 32*a* in the upper edge portion 32 of the rib 31 is formed so as to extend along the horizontal direction, and a continuous portion on one side (the left side in FIG. 4 or the like) in the longitudinal direction of the case 28 with respect to the top portion 32*a* is formed in an inclined portion 32*b* extending obliquely downward from the top portion 32*a*.

Figure 6B:
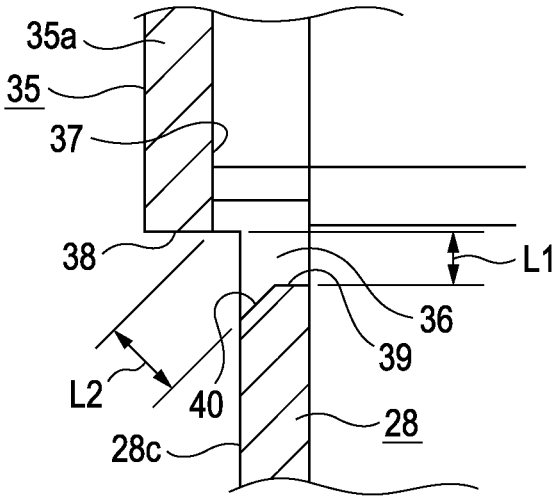
FIG. 6B is a cross-sectional view of major parts in the case.

Furthermore, in the lower part of the rear side wall 28*b* of a case of assuming the mounting direction when mounting the replacement component 29 in the case 28 to a front-back direction, a discharge port 33 to which the upstream end of the waste ink discharge tube 26 having the downstream end connected to the waste ink tank 24 is connected, and a supply port 34, to which the downstream end of the waste ink supply tube 25 having the upstream end connected to the cap 22 is connected, are formed. As shown in FIGS. 6A and 6B, both of the discharge port 33 and the supply port 34 are formed at the same height as the position near the lower part in the inclined ink receiving surface 30, and the discharge port 33 is formed at the position lower than the supply port 34 in the gravitational direction. In addition, as shown in FIGS. 5A and 5B, the supply port 34 is formed so that a plurality (four in the embodiment) of supply ports 34 is arranged in a parallel state in the width direction of the ink receiving surface 30.

In the upper part of the front side wall 28*c* of a case of assuming the mounting direction when mounting the replacement component 29 in the case 28 to a front-back direction, a mounting wall portion 35 having a thick wall portion 35*a* having a thickness dimension in the front-back direction greater than that of the front side wall 28*c* extends vertically upward. The rear wall portion 35*a* in the mounting wall portion 35 is separated and located in the transverse direction of the case 28 by a gap substantially corresponding to the gap between the pair of convex portions 50 protruding from the frame body portion 45*a* of the mounting member 45 in the replacement component 29. Moreover, in a part that is a boundary between the lower end portion of the rear wall portion 35*a* and the upper end portion of the front wall portion 28*c* in the mounting wall portion 35, an opening-shaped rectangular hole 36 penetrates and is formed as an example of the concave portion through which the convex portion 50 of the replacement component 29 side can be inserted or extracted in the mounting direction of the replacement component 29.

Moreover, as shown in FIGS. 4 and 6A and 6B, in response to the hole 36, in the rear wall portion 35*a* of the mounting wall portion 35, a groove 37 is formed so as to extend along the vertical direction which is able to guide the convex portion 50 of the replacement component 29 side while causing the convex portion 50 to slide in the direction toward the lower hole 36 from the upside of the hole 36. That is, the groove 37 is formed so that the lower end portion thereof communicates with the hole 36 in the vertical direction from the direct upside. As a result, as shown in FIG. 6B in an exploded manner, an upper inner surface 38 and a lower inner surface 39 of the hole 36 are formed so that the position of the upper inner surface 38 deviates forward from that of the lower inner surface 39 when assuming the mounting direction of the replacement component 29 with respect to the case 28 to the front-back direction.

Furthermore, from a middle position in the front-back position (=the longitudinal direction of the case 28) on the lower inner surface 39 of the hole 36, a chamfered portion 40 with a lowered front inclined shape extending to the front side opening (that is the mounting direction side) in the hole 36 is formed. As a result, the hole 36 is formed in a hole shape in which a gap L2 (that is, a vertical width of the opening of the insertion side when inserting the convex portion 50 into the hole 36 from the inclined direction) in the inclined direction between the rear end of the upper inner surface 38 and the front end) of the lower inner surface 39 (the position where the chamfered portion 40 intersects with the lower inner surface 38 is greater than a gap L1 in the vertical direction between the upper inner surface 38 and the lower inner surface 39. In addition, the gap L1 in the vertical direction between the upper inner surface 38 and the lower inner surface 39 of the hole 36 is a dimension corresponding to the thickness dimension of the convex portion 50 of the replacement component 29 side. In a state where the convex portion 50 is inserted into the hole 36 and then is engaged in the horizontal posture, the convex portion 50 is interposed from the both vertical sides by the upper inner surface 38 and the lower inner surface 39 of the hole 36.

In addition, in the upper part of the rear side wall 28*b* in the case where the mounting direction when mounting the replacement component 29 to the case 28 is assumed to the front-back direction, a locking portion 41 for elastically deforming and locking the hook portion 52 of the replacement component 29 side when the replacement component 29 is mounted into the opening portion 28*a* of the case 28 rises rearward. In addition, the locking portion 41 has a rectangular cross-sectional shape perpendicular to the vertical direction, and the upper part of the rear surface serving as the surface along the vertical direction is formed in a tapered surface 41*a* that makes the locking portion 41 thin as going toward the upper end.

Thus, next, the operation of the printer 11 configured as mentioned above will be particularly described taking notice of the operation at the time of replacing of the replacement component 29 in the FL box 23 and the operation at the time of driving of the suction pump 27 for cleaning the recording head 19. First, the operation at the time of replacing the replacement component 29 of the FL box 23 will be described.

When the ink absorption ability of the ink absorbent material 46 falls in the FL box 23, there is a need to replace the old ink absorbent material 46 with a new ink absorbent material 46. In this case, in the embodiment, the replacement work of the ink absorbent material 46 is performed in the unit of the replacement component 29 in which the ink absorbent material 46 is integrally incorporated to the mounting member 45.

Figure 7:
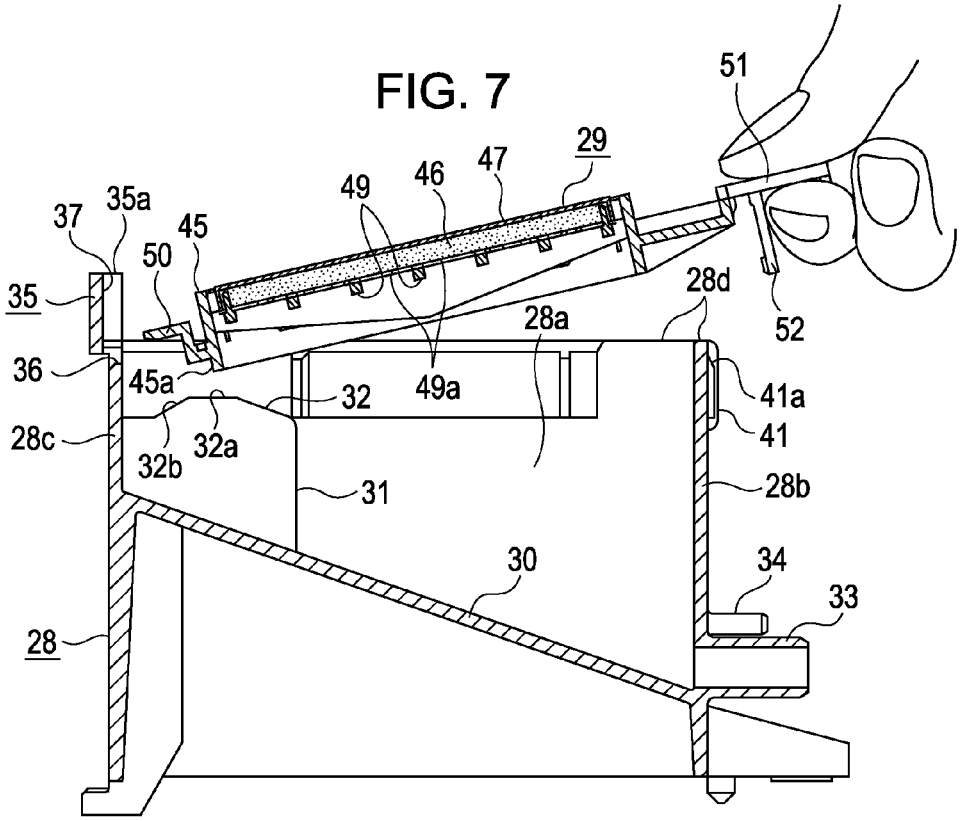
FIG. 7 is a cross-sectional view that shows a state when obliquely mounting the replacement component to the case from the back side.

That is, after detaching the old replacement component 29 from the opening portion 28*a* of the case 28 of the FL box 23, as shown in FIG. 7, at the upper position of the opening portion 28*a*, the new replacement component 29 is placed in the inclined posture with a lowered front in which the convex portion 50 faces forward. At this time, a user is able to easily make the replacement component 29 to the inclined posture with a lowered front, by gripping the gripping portion 51 protruding rearward from the rear part of the frame body portion 45*a* in the replacement component 29 with a finger tip.

Figure 8:
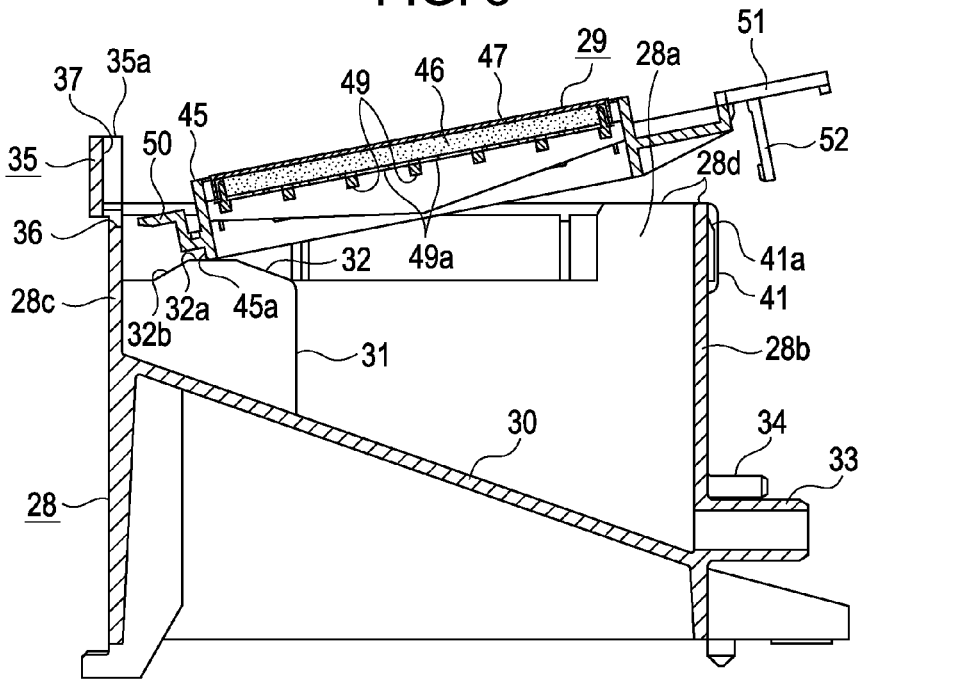
FIG. 8 is a cross-sectional view of a state where a frame body portion slides on and is guided by a rib from the state shown in FIG. 7.

Moreover, when lowering the replacement component 29 downward in the inclined state from the state shown in FIG. 7, as shown in FIG. 8, the lower end of the front portion of the frame body portion 45*a* in the replacement component 29 comes into contact with the rib 31 in the opening portion 28*a* in the case 28. At this time, since the upper edge portion 32 of the rib 31 comes into contact with the replacement component 29 from the downside in the gravitational direction, falling of the replacement component 29 into the opening portion 28*a* of the case 28 is suppressed. In addition, in the state shown in FIG. 8, the front lower end of the frame body portion 45*a* of the mounting member 45 in the replacement component 29 comes into contact with the top portion 32*a* extending in the horizontal direction of the upper edge portion 32 of the rib 31 along the mounting direction.

Moreover, when moving the replacement component 29 forward (the left part in FIG. 8) serving as the mounting direction while maintaining the state of the inclined posture from the state shown in FIG. 8, the replacement component 29 is guided so that the convex portion 50 moves toward the hole 36 while the frame body portion 45*a* slides on the upper edge portion 32 of the rib 31. In this respect, the rib 31 functions as a guide portion that causes the replacement component 29 to slide toward a direction facing the hole 36 and guides the replacement component 29. Moreover, when further moving the replacement component 29 forward in that state, in the replacement component 29, the frame body portion 45*a* shifts the sliding part to the inclined portion 32*b* continuously extending to the front inclined lower part from the top portion 32*a* of the upper edge portion 32 of the rib 31.

Moreover, when the sliding part thereof is sifted to the inclined portion 32*b* of the upper edge portion 32 of the rib 31, in the replacement component 29, the leading end of the convex portion 50 protruding forward from the frame body portion 45*a* is immediately inserted into the hole 36 of the case 28 side. In addition, in this case, in the hole 36 of the case 28 side, since the upper inner surface 38 is located so as to deviate forward rather than the lower inner surface 39, the vertical width (=L2) of the opening of the insertion side, in which the convex portion 50 is inserted into the hole 36 from the inclined direction, is secured to be greater than the thickness dimension (=L1) of the convex portion 50. Furthermore, the lower surface side of the convex portion 50 is formed in the tapered surface 50*a* that becomes thinner as going toward the leading end of the convex portion 50. For that reason, when the frame body portion 45*a* of the replacement component 29 shifts the sliding part to the inclined portion 32*b* of the upper edge portion 32 of the rib 31, the leading end of the convex portion 50 of the replacement component 29 is immediately and smoothly inserted into the hole 36 of the case 28 side.

Figure 9:
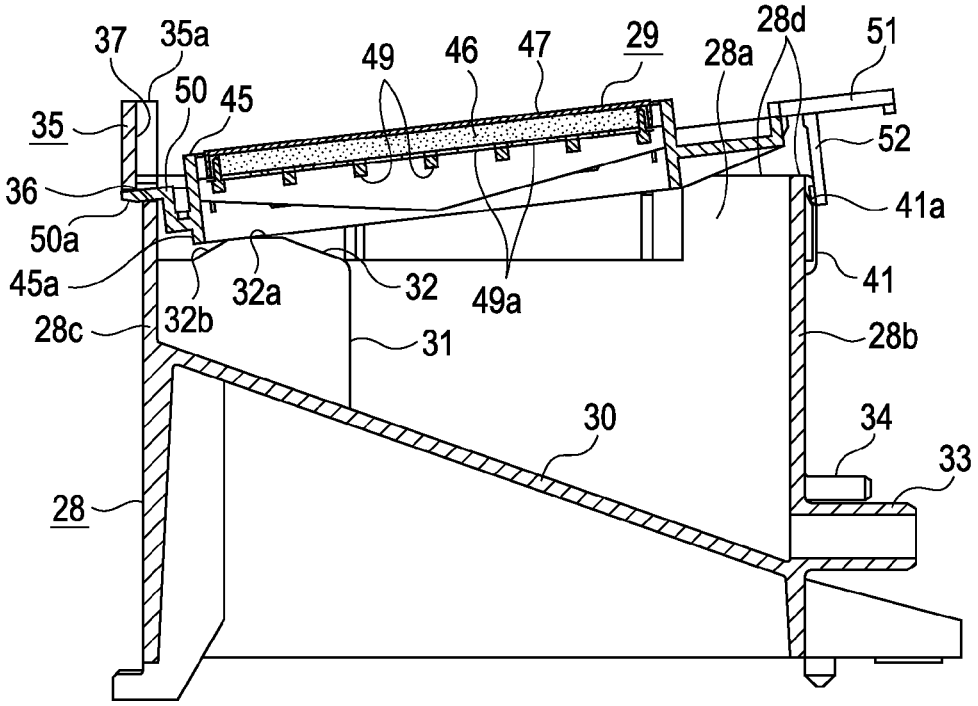
FIG. 9 is a cross-sectional view of a state where the replacement component is further moved from the state shown in FIG. 8 and a convex portion is inserted into a concave portion.

Moreover, when further moving the replacement component 29 forward from that state, as shown in FIG. 9, the replacement component 29 enters the state where the front lower end of the frame body portion 45*a* is separated from the upper edge portion 32 of the rib 31 in the inclined posture in which the convex portion 50 is deeply inserted into the hole 36. Furthermore, at the time, the replacement component 29 enters the inclined posture state where the lower end of the hook portion 52 provided behind the frame body portion 45*a* comes into contact with the tapered surface 41*a* of the locking portion 41 provided above the rear side wall 28*b* in the case 28.

Figure 10:
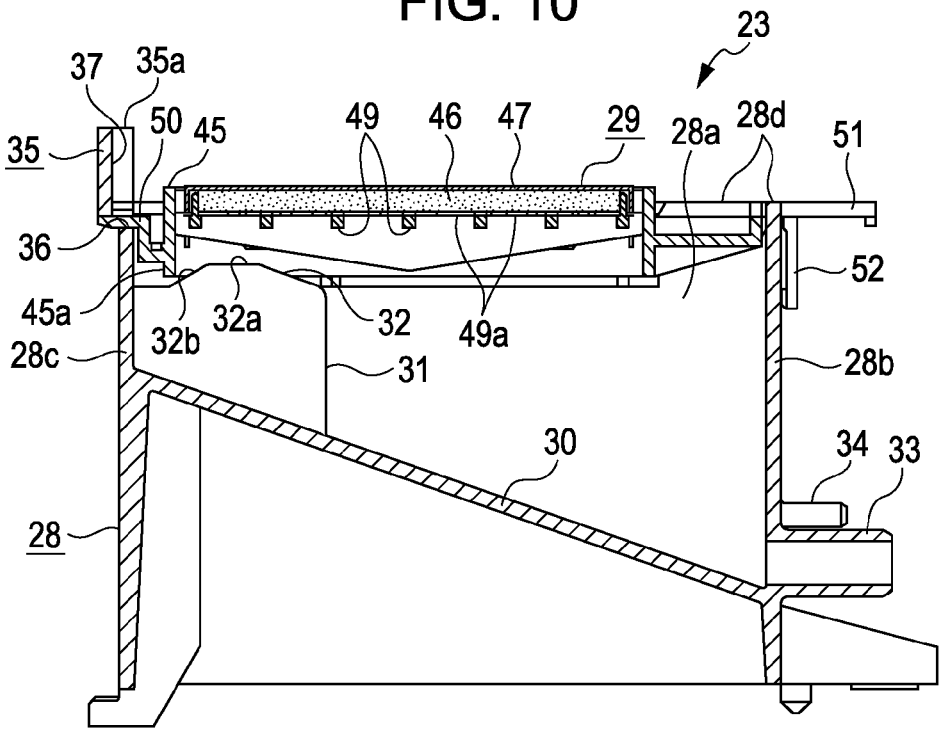
FIG. 10 is a cross-sectional view of a state where the replacement component is further moved from the state shown in FIG. 9 and the convex portion is engaged with the concave portion.

Moreover, when rotating and displacing the replacement component 29 from the state shown in FIG. 9 using the engagement part between the hole 36 and the convex portion 50 as a fulcrum so that the inclined posture state becomes the horizontal posture state in the state of inserting the convex portion 50 into the hole 36, as shown in FIG. 10, the hook portion 52 hanging down from the rear part of the frame body portion 45*a* is elastically deformed and is locked to the locking portion 41 of the case 28 side. Furthermore, at this time, in the hole 36, the engagement state is provided where the convex portion 50 is interposed between the upper inner surface 38 and the lower inner surface 39 of the hole 36 from both vertical sides. As a result, the replacement component 29 is mounted in the state where the horizontal posture is correctly positioned in the opening portion 28*a* of the case 28. Thus, in this respect, the hole 36 functions as a positioning portion that engages the replacement component 29 and making the replacement component 29 to the positioning state when mounting the replacement component 29.

Figure 11:
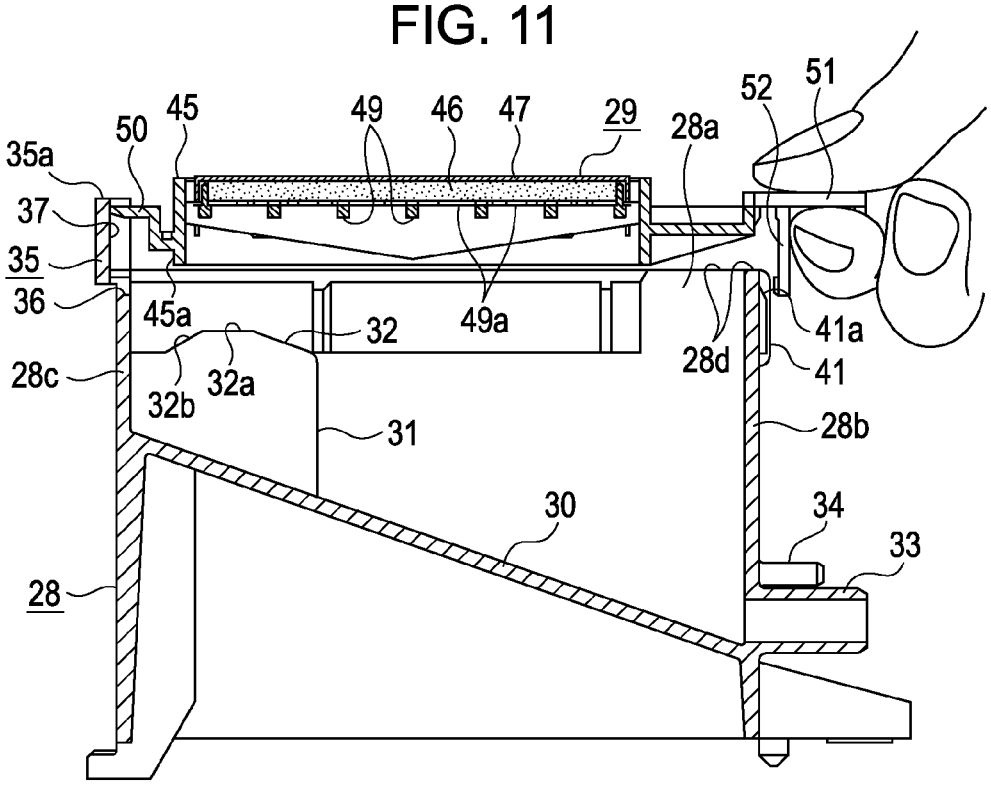
FIG. 11 is a cross-sectional view that shows a state when mounting the replacement component to the case from the upside.

In addition, when mounting the replacement component 29 into the opening portion 28*a* of the case 28, the replacement component 29 may not be guided in the direction toward the hole 36 using the rib 31 in the opening portion 28*a*, but the replacement component 29 may be guided to the hole 36 using the groove 37 formed in the mounting wall portion 35, as shown in FIG. 11. That is, as the guide portion that causes the replacement component 29 to slide in the mounting direction toward the hole 36 as the positioning portion and guides the replacement component 29, the groove 37 may function instead of the rib 31.

Figure 12:
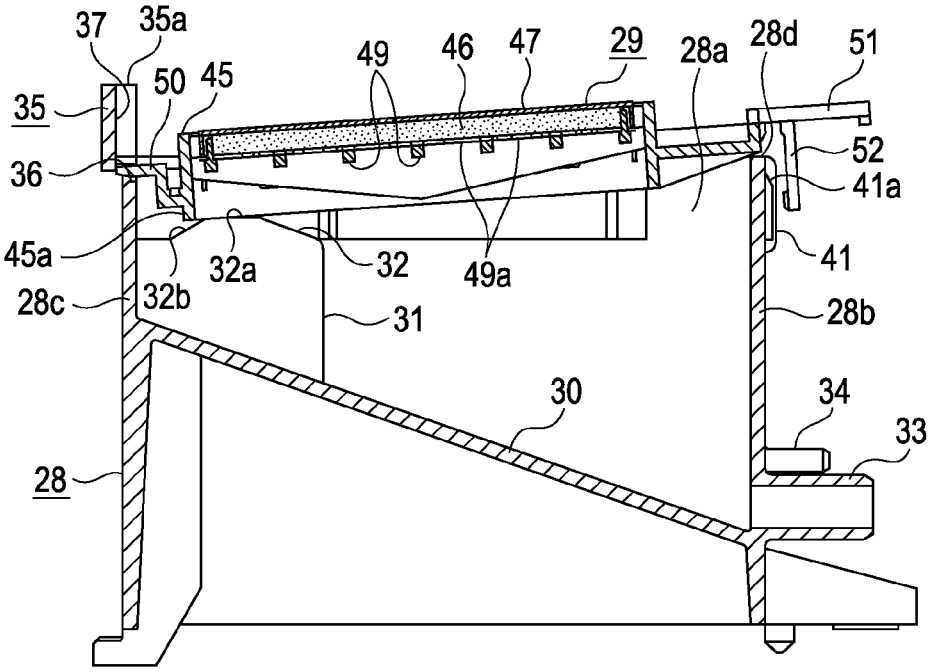
FIG. 12 is a cross-sectional view of a state where the replacement component is further moved from the state shown in FIG. 11 and the convex portion reaches the concave portion.

As shown in FIG. 11, in this case, at the upper position of the opening portion 28*a* of the case 28, the replacement component 29 is placed so as to be the horizontal posture in which the leading end of the convex portion 50 is inserted into the groove 37. Moreover, when lowering the replacement component 29 in the state of the horizontal posture from the state shown in FIG. 11, the replacement component 29 is guided toward the hole 36 as the positioning portion while the convex portion 50 slides on the groove 37. Moreover, first, as shown in FIG. 12, the rear portion (=the rear portion of the frame body portion 45*a*) of the replacement component 29 comes into contact with the upper end portion (the contact portion) 28*d* of the wall portion surrounding the opening portion 28*a* in the case 28 from above, and thus the replacement component 29 enters the inclined posture where the front of the frame body portion 45*a* falls down.

However, as shown in FIG. 11, in the case of the incomplete engagement state where the convex portion 50 is not engaged with the hole 36 in the positioning state, a part of the frame body portion 45*a* is placed above the opening portion 28*a* and in the region in which the carriage 16 equipped with the recording head 19 moves. For that reason, when the carriage 16 equipped with the recording head 19 moves, not the recording head 19 but the carriage 16 equipped with the recording head 19 collides with the replacement component 29 mounted in the incomplete engagement state. That is, even when the case 28 and the replacement component 29 are not correctly mounted, it is possible to prevent the recording head 19 from colliding with the replacement component 29 when the carriage 16 moves.

Furthermore, in the replacement component 29 entering the inclined posture with a lowered front, the convex portion 50 is guided by the groove 37, enters the hole 36 from above, and comes into contact with the lower inner surface 39 of the hole 36 in the state of the inclined posture with a lowered front. Moreover, at this time, the leading end of the convex portion 50 is located on the front side in the insertion direction rather than the lower inner surface 39 of the hole 36 in the hole 36. That is, the leading end of the convex portion 50 is located above the inclined chamfered portion 40 in the hole 36. For that reason, in the replacement component 29, the convex portion 50 is further guided to the front inclined lower part along the chamfered portion 40 with a lowered front according to gravity, and is smoothly and deeply inserted into the hole 36. That is, the replacement component 29 enters the inclined posture state as shown in above-mentioned FIG. 9. Moreover, the replacement component 29 is displaced to the horizontal posture shown in FIG. 10 from that state, and thus the replacement component 29 is mounted with respect to the case 28 in a correctly positioned state.

Meanwhile, when detaching the replacement component 29 in the state of being mounted into the opening portion 28*a* of the case 28, in the state shown in FIG. 10, after the locking state of the hook portion 52 with respect to the locking portion 41 is removed by a finger tip while gripping the gripping portion 51, the replacement component 29 is tilted so as to be the inclined state shown in FIG. 9. In addition, at this time, the chamfered portion 40 in the hole 36 functions as a roll-off portion that permits the inclined displacement of the convex portion 50 along with tilting of the replacement component 29.

Moreover, next, when moving the replacement component 29 in a direction (rearward) in which the convex portion 50 is extracted from the hole 36 from the state shown in FIG. 9, the lower end of the front portion of the frame body portion 45*a* in the replacement component 29 slides on the inclined portion 32*b* of the rib 31 in the case 28 and is guided to the rear inclined upper part. Moreover, when further moving the replacement component 29 rearward from that state, as shown in FIG. 8, since the lower end of the front portion of the frame body portion 45*a* slides on the horizontal top portion 32*a* in the upper edge portion 32 of the rib 31, the replacement component 29 can be detached from the case 28.

Next, the operation when the suction pump 27 is driven at the time of cleaning the recording head 19 will be described.

Figure 13:
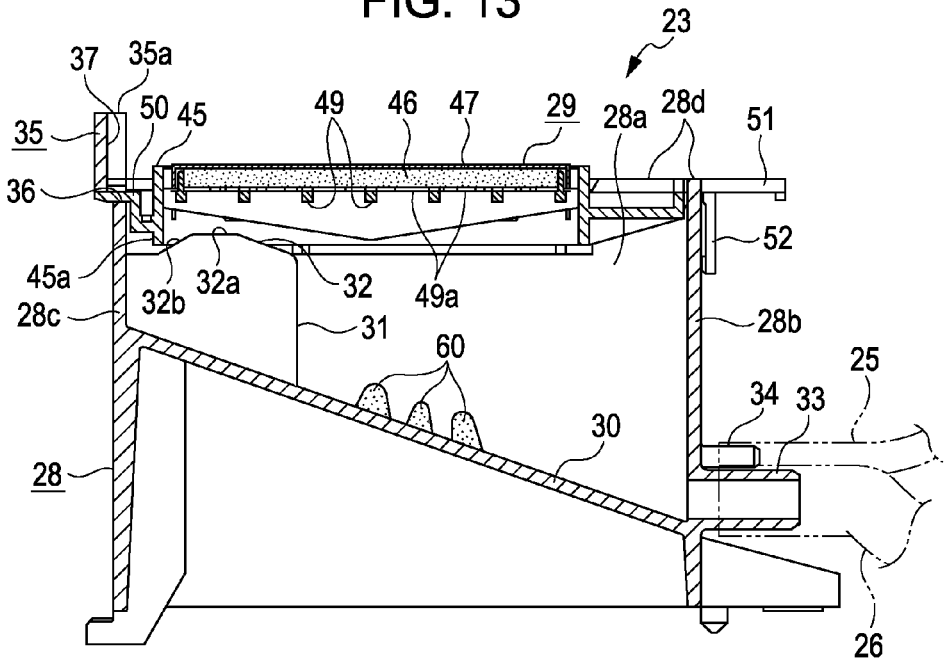
FIG. 13 is a cross-sectional view that shows a state where waste ink is attached onto an ink receiving surface in the case in a deposition form.
Figure 14:
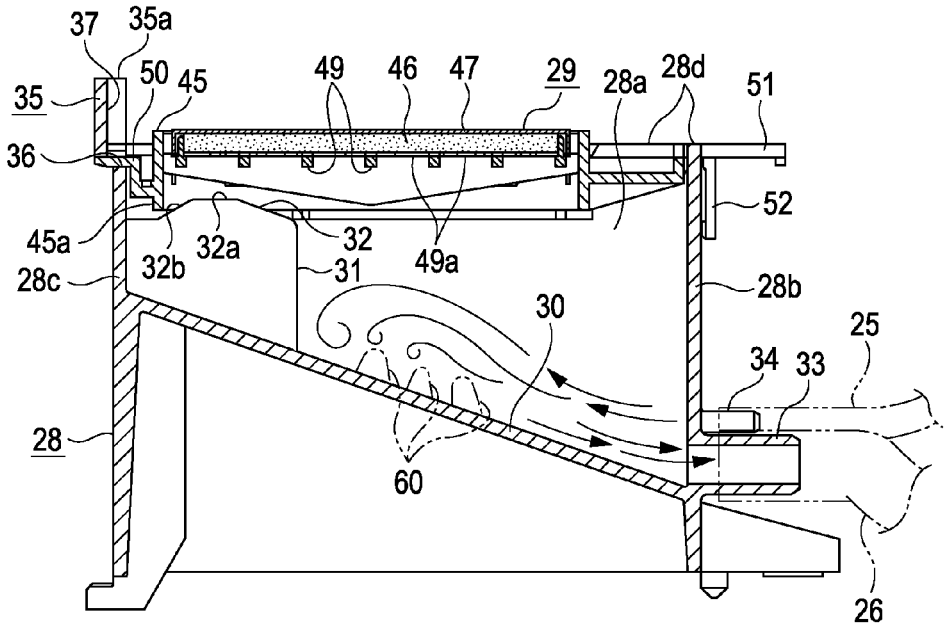
FIG. 14 is a cross-sectional view that shows a state where the waste ink flows down from the ink receiving surface in the case.

Ink, which is absorbed and maintained in the ink absorbent material 46 by flushing in the FL box 23 in which the replacement work of the replacement component 29 incorporated with the ink absorbent material 46 is performed, moves downward in the ink absorbent material 46 with passage of time. Moreover, the ink drops on the case 28 through the ink dropping port 49*a* formed on the lower surface side of the mounting member 45 and is attached onto the ink receiving surface 30. Moreover, when the ink repeatedly drops and the attachment of the ink with respect to the same location on the ink receiving surface 30 is repeated, as shown in FIG. 13, the ink is attached onto the ink receiving surface 30 to obtain a deposited aggregated deposit 60.

Meanwhile, when cleaning the recording head 19, as shown by a solid line in FIG. 2, the cap 22 is maintained at the contact position of coming into contact with the nozzle forming surface 19*a* of the recording head 19 in the state of surrounding the nozzle 19*b*, and the suction pump 27 is driven in that state. Then, the ink thickened from the nozzle 19*b* by negative pressure generated in the cap 22 is forcibly discharged into the cap 22 as the waste fluid. The suction pump 27 sucks the ink from the upstream side by the negative pressure and pushes and discharges the ink by positive pressure on the downstream side. For that reason, the waste ink is further vigorously discharged into the FL box 23 from the supply port 34 via the waste ink supply tube 25 by the discharge pressure of the suction pump 27.

Then, the waste ink is vigorously discharged toward to the ink receiving surface 30 in the case 28, and the waste ink flows so as to run up the inclined ink receiving surface 30 from the downside to the upside. Moreover, as shown by a two-dot-chain line in FIG. 14, in the middle of the flow, the waste ink takes the ink deposit 60 of the ink attached onto the ink receiving surface 30 in an aggregated state by momentum of the flow of ink. Moreover, next, the waste ink flows down the inclined ink receiving surface 30 toward the lower discharge port 33, together with the deposit 60 of the ink that is scrapped off when running up the inclined ink receiving surface 30. Moreover, the waste ink flowed down the inclined ink receiving surface 30 is discharged to the waste ink tank 24 from the discharge port 33 via the waste ink discharge tube 26, together with the deposit 60 of the ink scrapped off from the ink receiving surface 30.

In addition, when driving of the suction pump 27 is stopped along with the cleaning end of the recording head 19, the supply of the waste ink flowed on the FL box 23 side (the downstream side) via the waste ink supply tube 25 from the cap 22 side (the upstream side) until then is stopped. For that reason, the waste ink remaining in the waste ink supply tube 25 at the time of stopping tries to flow in the waste ink supply tube 25 toward the low direction according to gravity. That is, in this case, since the site connected to the FL box 23 in the waste ink supply tube 25 is low, the residual ink in the waste ink supply tube 25 naturally flows in the FL box 23.

Furthermore, although a large amount of waste ink is supplied into the FL box 23 from the cap 22 side via the waste ink supply tube 25 along with driving of the suction pump 27 when cleaning the recording head 19, the large amount of waste ink is discharged to the waste ink tank 24 via the waste ink discharge tube 26 having the flow path diameter formed to be greater than that of the waste ink supply tube 25. For that reason, the waste ink does not unnecessarily stay in the case 28 of the FL box 23.

Furthermore, even if clogging of the ink occurs on the downstream side of the waste ink discharge path rather than the FL box 23, such as the waste ink discharge tube 26 by which the FL box 23 and the waste ink tank 24 are connected to each other, since the FL box 23 communicates with the atmosphere, the pressure in the FL box 23 does not increase.

According to the above-mentioned embodiment, the following effects can be obtained.

(1) The replacement component 29 replaced and mounted for maintenance of the ink absorption function is configured so that the convex portion 50 is guided so as to be inserted toward the hole 36 of the case 28 while sliding on the rib 31 (or the groove 37) of the case 28, and the replacement work is easy. Moreover, the replacement component 29 is mounted with respect to the case 28 in a correctly positioned state when the convex portion 50 is engaged with the hole 36. Thus, it is possible to easily and correctly mount the replacement component 29 replaced for maintenance of the ink absorption function if necessary in the FL box 23 configured to receive the ink discharged from the recording head 19 as the waste fluid.

(2) When mounting the replacement component 29 within the opening portion 28*a* of the case 28, the rib 31 in the case 28 comes into contact with the replacement component 29 from the downside in the gravitational direction, thereby to suppress the depression of the replacement component 29 into the opening portion 28*a*. For that reason, it is possible to guide the replacement component 29 in the direction in which the convex portion 50 is smoothly engaged with the hole 36 of the case 28.

(3) When moving the replacement component 29 in the mounting direction while causing the frame body portion 45*a* to slide on the upper edge portion 32 of the rib 31 in the opening portion 28*a* in the case 28, while making the frame body portion 45*a* of the replacement component 29 to the inclined posture with a lowered front, the leading end of the convex portion 50 protruding from the frame body portion 45*a* is inserted into the hole 36 serving as the positioning portion. Moreover, when causing the frame body portion 45*a* to slide on the inclined portion 32*b* of the rib 31 while further inserting the convex portion 50 into the hole 36 from that state, it is possible to return the frame body portion 45*a* of the replacement component 29 to the horizontal posture from the inclined posture and mount the frame body portion 45*a* in the positioning state. Meanwhile, when extracting the convex portion 50 from the hole 36 to detach the replacement component 29 from the case 28, if the frame body portion 45*a* of the replacement component 29 is set to the inclined posture from the horizontal posture, and is moved in the detachment direction serving as an opposite direction of the mounting direction while causing the frame body portion 45*a* of the replacement component 29 to slide on the inclined portion 32*b* with a lowered front of the rib 31 in that posture, the replacement component 29 can be smoothly detached from the case 28.

(4) When inserting the convex portion 50 into the hole 36 serving as the concave portion in the case 28 while setting the frame body portion 45*a* of the replacement component 29 to the inclined posture with a lowered front, the opening of the insertion side of the convex portion 50 in the hole 36 can be obtained widely when viewed from the side of the convex portion 50, and it is easy to insert the convex portion 50 into the hole 36. Furthermore, after inserting the convex portion 50 into the hole 36, when turning the frame body portion 45*a* of the replacement component 29 to the horizontal posture from the inclined posture, the convex portion 50 inserted into the hole 36 enters the fitting state of being interposed between the upper inner surface 38 and the lower inner surface 39 of the hole 36, and thus it is easy to maintain the replacement component 29 in the positioning state.

(5) By causing the convex portion 50 of the frame body portion 45*a* of the replacement component 29 to slide on the groove 37, it is possible to guide the convex portion 50 up to the hole 36 from above.

(6) The replacement component 29 is configured so that, when the convex portion 50 is guided up to the hole 36 along the concave groove 37 from above comes into contact with the lower inner surface 39 of the hole 36, since the convex portion 50 is further guided downward with a lowered front along the chamfered portion 40 with a lowered front formed on the lower inner surface 39 according to gravity, the convex portion 50 is smoothly inserted into the hole 36, and the mounting work can be rapidly performed. Meanwhile, when detaching the replacement component 29 in the mounted state from the case 28, at the time of setting the frame body portion 45*a* of the replacement component 29 from the horizontal posture to the inclined posture, since the chamfered portion 40 also serves as a run-off portion permitting the inclined displacement of the convex portion 50, the detachment work can be smoothly performed.

(7) A part of the frame body portion 45*a* of the replacement component 29 is located above the opening portion 28*a* and in the region in which the carriage 16 equipped with the recording head 19 moves, in the case of the incomplete engagement state where the convex portion 50 is not engaged with the hole 36 in the positioning state. For that reason, when the carriage 16 equipped with the recording head 19 moves, not the recording head 19 but the carriage 16 equipped therewith collides with the replacement component 29 mounted in the incomplete engagement state. That is, even when the replacement component 29 is not correctly mounted to the case 28, the recording head 19 can be prevented from colliding with the replacement component 29 during movement of the carriage 16, and thus the damage of the recording head 19 can be suppressed.

(8) In the replacement component 29 of the state of inserting the convex portion 50 into the hole 36, when the convex portion 50 is subjected to the rotation displacement from the inclined posture with a lowered front to the horizontal posture so as to be the positioning state within the hole 36, the hook portion 52 is elastically deformed and is locked to the locking portion 41, and thus the correct mounted positioning state can be satisfactorily maintained.

(9) When the ink is ejected (that is, flushed) toward the case 28 from the nozzles of the recording head 19 in the state of the liquid droplet as the waste ink, the ink is attached into the ink receiving surface 30 of the case 28. Meanwhile, when the suction pump 27 is driven in the state of setting the cap 22 to the contact position with respect to the recording head 19, the ink is forcibly discharged from the recording head 19. Moreover, the forcibly discharged ink is led up to the case 28 via the cap 22 and the liquid supply path and is vigorously discharged toward the ink receiving surface 30 onto which the ink is attached in the case 28 at the discharge pressure due to driving of the suction pump 27. Thus, it is possible to cause the ink attached onto the ink receiving surface 30 from the ink receiving surface 30 using the flow of the waste ink so as not to be solidified to the aggregated form.

(10) The ink discharged toward the ink receiving surface 30 from the waste ink supply tube 25 scrapes off the deposit 60 of ink attached onto the ink receiving surface 30, when flowing so as to run up the inclined ink receiving surface 30 from below. Moreover, after the ink flows on the ink receiving surface 30 so as to drop down, together with the deposit 60 of ink scrapped off from the ink receiving surface 30 when running up, the ink and the deposit flows out to the waste ink discharge tube 26 from the case 28. For that reason, it is possible to reduce the risk of the ink attached onto the ink receiving surface 30 in the case 28 from being solidified.

(11) It is possible to reduce the quantity of ink remaining on the suction pump 27 side after driving of the suction pump 27 stops, in the ink flowing to the case 28 side from the cap 22 side via the waste ink supply tube 25 along with driving of the suction pump 27.

(12) Since the waste ink, which flows in via the waste ink supply tube 25, can be discharged via the waste ink discharge tube 26 having the flow path diameter greater than that of the waste ink supply tube 25, it is possible to reduce the risk of the unnecessary remaining of the waste ink within the case 28.

(13) In a case where the inside of the case 28 formed with the ink receiving surface 30 does not communicate with the atmosphere, when clogging occurs on the downstream side of the waste ink discharge tube 26, the waste ink may flow backward to the inside of the waste ink supply tube 25 of the upstream side via the case 28 due to the pressure. In this respect, according to the printer 11 of the embodiment, even if clogging occurs on the downstream side of the waste ink discharge tube 26, since the pressure causing the reverse-flow is opened to the atmosphere by the case 28 communicating with the atmosphere, an occurrence of the reverse-flow can be suppressed.

In addition, the above-mentioned embodiment may be modified as follows.

In the above-mentioned embodiment, the discharge port 33 and the supply port 34 may not be provided on the same side wall in the case 28. For example, the supply port 34 may be formed on the front side wall 28*c* on the opposite side to the rear side wall 28*b* formed with the discharge port 33.

In the above-mentioned embodiment, the locking portion 41 of the case 28 may be formed on the inner surface side of the rear side wall 28*b*, and the hook portion 52 of the mounting member 45 may be engaged with the locking portion 41 within the opening portion 28*a* of the case 28.

In the above-mentioned embodiment, each one of the hole 36 of the case 28 and the convex portion 50 of the mounting member 45 may be provided, and three or more of them may be provided by.

In the above-mentioned embodiment, each one of the rib 31 of the case 28 may be provided, and three or more of them may be provided. However, when providing only one rib 31, it is preferable that the thickness size of the rib 31 in the transverse direction perpendicular to the longitudinal direction of the replacement component 29 have enough size to be able to suppress the falling-down of the replacement component 29 into the opening portion 28*a* when mounting the replacement component 29 into the opening portion 28*a* of the case 28.

In the above-mentioned embodiment, the chamfered portion 40 formed in the hole 36 of the case 28 may be formed not on an inclined surface but on a circular arc surface, or the chamfered portion 40 may be excluded.

In the above-mentioned embodiment, the groove 37 of the case 28 may be excluded.

In the above-mentioned embodiment, the concave portion of the case 28, with which the convex portion 50 of the mounting member 45 is engaged in the positioning state, may be a non-through hole if the convex portion is inserted into or extracted from the concave portion, without being limited to the through-formed hole 36.

In the above-mentioned embodiment, the guide portion formed in the case 28 may be replaced with a beam formed along the mounting direction of the replacement component 29 into the opening portion 28*a* from the inner surface of the side wall of the case 28.

In the above-mentioned embodiment, the cross-sectional shape perpendicular to the projecting direction of the convex portion 50 of the mounting member 45 may not be a rectangular shape. In addition, in this case, there is a need to form the hole 36 of the case 28, into which the convex portion 50 is inserted, to the shape corresponding to the convex portion 50.

In the above-mentioned embodiment, the rib 31 formed in the case 28 may be configured so that the top portion 32*a* in the upper edge portion 32 is not horizontally provided.

In the above-mentioned each embodiment, although the liquid ejecting apparatus has been embodied as the ink jet type printer 11 configured to eject the ink as the fluid, the liquid ejecting apparatus may be embodied as a fluid ejecting device that ejects or discharges other fluids other than ink. It is possible to utilize various liquid ejecting apparatuses that include a liquid ejecting head or the like configured to discharge a minute amount of liquid droplets. In addition, the liquid droplet refers to a liquid state that is discharged from the liquid ejecting apparatus, and also includes one leaving traces in a granular shape, a tear shape, and a filiform shape. Furthermore, liquid described herein may be a material capable of being ejected from the liquid ejecting apparatus. For example, the material may include a state when a substance is a liquid phase, and includes a liquid state having high or low viscosity, sol, gel water, other inorganic solvents, an organic solvent, a solution, a liquid phase resin, a flow regime like a liquid phase metal (a metallic melt), substance in which one phase is a liquid, as well as material in which particles of a functional material formed of solid bodies such as pigment and metallic particles are dissolved, dispersed or mixed into the solvent or the like. Furthermore, as a typical example of liquid, there is ink, liquid crystal, or the like as described in the above-mentioned embodiment. Herein, ink includes various liquid compositions such as a general water-based ink, an oil-based ink, gel ink, and hot-melt ink. As a specific example of the liquid ejecting apparatus, for example, there is a liquid ejecting apparatus which ejects liquid including materials such as an electrode material and a color material that are used in manufacturing a liquid crystal display, an EL (electroluminescence) display, a surface emitting display, and a color filter in the form of dispersion or dissolution. Otherwise, it may be possible to adopt a liquid ejecting apparatus which ejects biological organic matter used in manufacturing a bio chip, a liquid ejecting apparatus which is used as a precision pipette and ejects liquid serving as a sample, a printing device, a micro dispenser or the like. In addition, it may be possible to adopt a liquid ejecting apparatus which pinpoint-ejects lubricant oil to a precision machine such as a watch and a camera, a liquid ejecting apparatus which ejects transparent resin liquid such as an ultraviolet curing resin onto a substrate so as to form a micro hemispherical lens (an optical lens) or the like used in an optical communication element or the like, a liquid ejecting apparatus which ejects etching liquid such as acid or alkali so as to etch a substrate or the like. Furthermore, the invention can be applied to any one kind of these liquid ejecting apparatuses.

The entire disclosure of Japanese Patent Application No. 2012-057371, filed Mar. 14, 2012, is expressly incorporated by reference herein.

What is claimed is:

1. A liquid ejecting apparatus comprising:

a liquid ejecting head that ejects liquid from nozzles;

a liquid accommodation body having a liquid receiving surface configured to accommodate the liquid flushed from the nozzles;

a pump that discharges the liquid;

a liquid supply flow path that discharges the liquid discharged by the pump toward the liquid receiving surface in the liquid accommodation body; and a liquid discharge flow path that discharges the liquid from the liquid accommodation body to a separate waste liquid tank, wherein the liquid receiving surface forms an inclined surface shape, and a discharge port configured to discharge the liquid toward the liquid receiving surface from the liquid supply flow path is formed on a lower side of the liquid receiving surface in a vertical direction.

2. The liquid ejecting apparatus according to claim 1, wherein the pump is a pump that discharges the liquid ejected from the nozzles of the liquid ejecting head via a cap capable of coming into contact with the nozzles so as to surround the nozzles.

3. The liquid ejecting apparatus according to claim 1, wherein the liquid supply flow path is configured so that a height of a part connected to the liquid accommodation body in the vertical direction is lower than that of a part serving as the pump side.

4. The liquid ejecting apparatus according to claim 1, wherein a flow path diameter of the liquid discharge flow path is greater than a flow path diameter of the liquid supply flow path.

5. The liquid ejecting apparatus according to claim 1, wherein the inside of the liquid accommodation body formed with the liquid receiving surface communicates with atmosphere.

6. The liquid ejecting apparatus according to claim 1, wherein the liquid discharge flow path is formed at the position lower than the liquid supply flow path in the gravitational direction.

* * * * *